US006323604B1

(12) United States Patent
Boenigk et al.

(10) Patent No.: US 6,323,604 B1
(45) Date of Patent: Nov. 27, 2001

(54) CIRCUIT ARRANGEMENT, AN ASSIGNED ELECTRICAL SYSTEM AND A DISCHARGE LAMP WITH SUCH A CIRCUIT ARRANGEMENT, AND A METHOD FOR OPERATING IT

(75) Inventors: Michael Boenigk; Klaus Guenther, both of Berlin (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/572,624

(22) Filed: May 17, 2000

(30) Foreign Application Priority Data

May 20, 1999 (DE) ..... 199 23 237

(51) Int. Cl.[7] ..... H05B 37/00

(52) U.S. Cl. ..... 315/290; 315/289; 315/194; 315/244; 315/58

(58) Field of Search ..... 315/289, 290, 315/194, 186, 188, 192, 239, 227 R, 241 R, 244, 242, 243, 282, 58, 62, DIG. 2, DIG. 5

(56) References Cited

U.S. PATENT DOCUMENTS

| | | | | |
|---|---|---|---|---|
| 3,732,460 | | 5/1973 | Wattenbach | 315/123 |
| 3,925,705 | | 12/1975 | Elms et al. | 315/246 |
| 4,342,948 | | 8/1982 | Samuels | 315/290 |
| 4,678,968 | * | 7/1987 | Lester | 315/290 |
| 4,808,888 | * | 2/1989 | Wyner et al. | 315/289 |
| 4,958,107 | * | 9/1990 | Mattas et al. | 315/289 |
| 5,185,557 | | 2/1993 | Luijks et al. | 315/59 |
| 5,336,974 | | 8/1994 | Luijks et al. . | |
| 6,184,635 | * | 2/2001 | Boenigk | 315/291 |

FOREIGN PATENT DOCUMENTS

| | | |
|---|---|---|
| 3148821 | 7/1982 | (DE) . |
| 3426491 | 2/1985 | (DE) . |
| 3438003 | 4/1986 | (DE) . |
| 0168087 | 1/1986 | (EP) . |
| 0181666 | 5/1986 | (EP) . |
| 0181667 | 5/1986 | (EP) . |
| 9621337 | 7/1996 | (WO) . |

* cited by examiner

*Primary Examiner*—Haissa Philogene
(74) *Attorney, Agent, or Firm*—Carlo S. Bessone

(57) ABSTRACT

A high-pressure discharge lamp has integrated in its base or base housing a circuit arrangement (SCH) which combines a starting device and a power reducing circuit which comprises a phase-gating control (PS). A capacitor (C2) connected in parallel with the lamp (L) provides a transfer voltage which is distinctly higher than the input voltage of the arrangement.

19 Claims, 12 Drawing Sheets

CIRCUIT ARRANGEMENT, AN ASSIGNED ELECTRICAL SYSTEM AND A DISCHARGE LAMP WITH SUCH A CIRCUIT ARRANGEMENT, AND A METHOD FOR OPERATING IT

TECHNICAL FIELD

The invention relates to high-pressure and extra-high-pressure discharge lamps which are becoming increasingly widespread in all sectors of lighting engineering, because of their good luminous efficiency. Owing to their specific properties, they are mostly difficult to start and operate. This holds, in particular, for sodium high-pressure lamps with a relatively high xenon pressure. Because of their outstanding luminous efficiency, these lamps are particularly well suited for street lighting. In this case, they frequently replace existing systems with a substantially lower efficiency, for example mercury-vapor lamps. In addition, in this formulation of the problem, it is also necessary to solve the problem of power reduction (in conjunction with an identical luminous flux), the result of all this being a saving in energy.

The invention also relates to a method for starting and operating a discharge lamp. In particular, a circuit arrangement is described which permits the operation of a sodium high-pressure lamp with a high inert gas filling pressure (typically 2 atm xenon) and a low power output at a ballast inductor for high powers (this arrangement is known as retrofit or plug-in technology), the starting of the lamp being rendered substantially more difficult, in particular, because of the very high cold filling pressure.

PRIOR ART

So far, attempts have been made to solve the problem of the impeded starting of high-pressure discharge lamps (in particular in the case of the replacement of a mercury-vapor discharge lamp by a sodium high-pressure lamp) through, for example, special starting aids, through internal starters or through special starting gas mixtures. In the two first cases, however, the ballast inductor is fully loaded in the process with the starting voltage, while in the latter case the lighting properties of the lamp are impaired.

Adapting sodium high-pressure lamps to existing burning positions for mercury-vapor lamps as regards their electric data (for example magnitude of the inductor current) and lighting data (for example luminous flux) has not yet been satisfactorily solved with previous means.

Circuit arrangements which are particularly suitable for retrofitting applications are described, for example, in DE-A 31 48 821, EP-A 181 666 and EP-A 181 667 and EP 168 087. DE-A 31 48 821 describes, in particular, a circuit, based on a capacitor, for a high-pressure discharge lamp with an auxiliary starting electrode which provides an increased voltage between the two main electrodes. However, these circuits cannot be used to start lamps with a very high cold filling pressure. U.S. Pat. No. 3,732,460 describes a circuit for fast cold and warm starting with pulses of up to 20 kV. The circuit uses a capacitor connected in parallel with the electrodes, as a result of which the no-load voltage can be increased up to three times the value.

Furthermore, circuits with very wide (high-energy) pulses are known; they permit the starting and transfer of arc tubes with a very high cold filling pressure. However, this requires very large, voluminous starting inductors for rectified RF pulses (DE-A 34 26 491). Or a so-called internal starter, which briefly short-circuits the ballast inductor, generates a relatively wide starting pulse. A corresponding arrangement is to be found, for example, in U.S. Pat. No. 5,336,974 and U.S. Pat. No. 5,185,557. However, it is disadvantageous that the ballast inductor is loaded in this case with the entire starting voltage. This is damaging to most ballasts.

There is likewise a multiplicity of proposals with regard to the power reduction of lamps. The conventional technology is based on a phase-gating control such as is described, for example, in U.S. Pat. No. 3,925,705 and DE-A 34 38 003. An RC element is connected in parallel in both cases to a semiconductor switching element (for example a sidac or a diac-controlled triac). In order to avoid the replacement of an already existing ballast, use is made of a retrofit lamp in which a capacitor is arranged in parallel with the discharge vessel in the outer bulb (WO 96/21337 and EP 030 785). A disadvantage in this case is the difficulty of implementation and, in some circumstances, the complicated measures for following the radio-interference regulations.

SUMMARY OF THE INVENTION

It is the object of the present invention to provide a circuit arrangement which starts an electrode discharge lamp quickly and simply and requires few electronic components therefor. An additional object is to specify a method for operating such a lamp, and to specify a compact assembly of lamp and circuit arrangement.

The object has been achieved in accordance with the invention by developing a circuit arrangement in which a capacitor connected in parallel with the assigned lamp is charged up to a voltage (transfer voltage) higher than the required and previously exclusively targeted (customary) no-load voltage. The no-load voltage corresponds to the input voltage in the case of conventional ballasts. This voltage is made immediately available to the plasma after breakdown has occurred. The increased voltage is provided by means of at least one of the following measures: by means of the closing operation on a resonant circuit (preferred), by means of a resonant increase or by means of a combination of the two.

The power reduction is performed by means of a phase-gating control known in principle per se (see above). In this case, in order to maintain the maximum permissible radio-interference voltage the capacitor (transfer capacitor) connected in parallel with the lamp can be disconnected from the electrical circuit after starting of the lamp, thus preventing the periodic switching of a low-resistance source to a capacitor.

It has emerged that in the case of discharge lamps the voltage available after the first breakdown is crucial in some cases for the final transfer of the arc.

Discharge lamps with a very high filling pressure (for example sodium-vapor high-pressure lamps with a very high xenon cold filling pressure of typically 1 to 3 bar) can frequently be started only with difficulty, since a high starting voltage is required for the first breakdown, and the transfer proceeds only very hesitantly.

They require pulses with a very high voltage and power for starting and transfer. Moreover, a high transfer voltage favors successful transfer of the arc as early as after the first breakdown.

Surprisingly, it proved possible to find a simple circuit arrangement with the aid of which it was possible to start and operate even lamps which were very unwilling to start, the circuit outlay being very low, and therefore cost-effective and space-saving, with the result that the circuit can be accommodated at least partially in the base of the assigned lamp. Since the starting pulses can be kept relatively narrow (at least two to ten times narrower than in the abovementioned prior art) owing to the principle of a circuit as defined in the invention, there is no need for any voluminous inductors. The ballast inductor is not loaded with the starting voltage.

The invention is suitable, in particular, for so-called retrofit (plug-in) lamps, a typical example being a circuit arrangement for starting and operating a 70 W sodium high-pressure lamp (with 2 atm xenon cold filling pressure) at a burning position for originally a 125 W mercury-vapor lamp, using the original ballast inductor. In a particularly preferred embodiment, the aim is simultaneously to permit the lamp power to be adjusted (preferably reduced).

As defined in the invention, a circuit arrangement has been developed in which a capacitor (transfer capacitor) connected in parallel with the lamp is charged up to a voltage (transfer voltage $U_{transfer}>\sqrt{2}\times U_{line\text{-}off}$) which is higher than the required (customary) no-load voltage. This voltage is made immediately available to the plasma after breakdown has occurred. The increased voltage is preferably provided by means of a closing operation on a resonant circuit.

The present invention can be subdivided into two networks, specifically one for the power reduction (per phase intersection), and one for the actual starting circuit.

One of the known phase-gating controls is preferably used for the power reduction, in which case, however, no network is required in some circumstances for a simmering power, depending on the discharge vessel used (for example one made from ceramic for a sodium high-pressure lamp) (see DE-A 34 38 003, for example). The lamp used by way of example (retrofit lamp with sodium vapor and 2 atm xenon) requires approximately half the power to achieve the same lighting data as the mercury-vapor lamp originally conceived for this burning position. The power is reduced from, for example, 120 W to approximately 60 W by gating each sine half-wave with a phase angle of approximately 1 to 2 ms. A triac serves advantageously as switching element. The phase angle is determined by a starting circuit (for example RC element with diac) assigned to the triac. A varistor, diac, limiter diode, or the like can further be inserted for the purpose of stabilizing the phase angle in the case of a variable line voltage (stabilizing the charging voltage for the capacitor of the gate starting circuit of the diac).

The drive circuit of the triac (gate starting circuit) can be designed both with coupling to the reference potential on only one side in terms of direct current (see FIG. 1*b*) and with direct coupling (FIGS. 1*c*, 2*b*).

The starting device of the circuit arrangement according to the invention preferably constitutes superimposed starting. After application of a line voltage $U_0$ and switching-through of a switching element S1 (for example a triac Q1), the transfer capacitor of the starting circuit (C2) is firstly charged by the current of the ballast inductor L1 (inductor current). The transfer capacitor (C2) forms a series resonant circuit with the lamp ballast inductor L1, the resonant frequency $f_r$ being determined by:

$$f_r=1/(2\pi\sqrt{L1C2}).$$

This resonant circuit is excited by switching through the switching element S1.

Switching in the respective phase-gated sine half-wave by means of the switching element S1 can be regarded as a jump function (closing operation). In this case, a voltage rise of at most $2\times U_0$ can occur across the capacitor C2.

When a relatively slow switching element (slow thyristor type or else a triac or additional network via the switching element S1) is used, the energy stored on the capacitor C2 can flow back in the event of a drop in the supply voltage (falling part of the line sine-wave). Under these conditions, every new line half wave which again causes a closing jump encounters a defined initial condition where $U_{C2}\approx 0V$.

The charge is maintained on the capacitor C2 when use is made of a fast switching element (for example, a frequency thyristor or triac with an appropriate circuit for clearing the gate circuit—see FIG. 2*b*). Each new line half-wave (closing jump) thus encounters a negative precharge on the capacitor C2, which leads to a higher current in the recharging or charging-up of C2. Said current produces a resonant voltage rise across L1, which is transmitted in turn to C2. The result of this mechanism is a yet greater voltage rise with each line half wave. Voltage rises which are greater than twice the line voltage are therefore possible.

Preventing the charge of C2 from swinging back generates a virtually square-wave transfer voltage with a half period of typically 1 to 100 ms. A half period of 5 to 15 ms is particularly favorable for the transfer.

The voltage across the transfer capacitor C2 is likewise preferably applied via a switching means (S2) of an additional network of a starting circuit (a spark gap is preferably used). If the starting voltage of this spark gap is reached, the latter breaks down, and a further, third capacitor is preferably charged. The current now flowing (approximately 100 A) generates in the primary winding of a starting transformer T1 a voltage which is stepped up via its secondary winding and is present at the electrodes of the lamp. The transfer capacitor C2 blocks this high voltage from the remainder of the circuit (in particular the ballast inductor). Moreover, the transfer capacitor closes the circuit toward the lamp. This process is repeated several times within a half wave, a charge division taking place in each case between the transfer capacitor C2 (the result there being a voltage drop) and the third capacitor C3 (the corresponding voltage rise resulting there). In the course of a line half wave, the capacitor C2 is thereby finally charged to a voltage which is further increased. This voltage is available as transfer voltage for the lamp, the charge of the transfer capacitor (with the increased transfer voltage) being available at low resistance for heating up the plasma. By contrast, the mere current limited by the ballast impedance (as used in the prior art) is frequently not sufficient for transferring the arc.

The starting pulse can be shaped additionally with the aid of a further impedance in the primary circuit of the starting transformer. This impedance can preferably be implemented by an inductor L3 (for AC) or else by a resistor or the like (for DC).

After starting has been effected and the arc has been transferred in the lamp, the capacitor (transfer capacitor C2) connected in parallel with the lamp can be isolated from the circuit by means of a further switching element S3 connected in series therewith (a spark gap is preferably used). This can be recommended, in particular, in order to observe the statutory regulations on permissible radio-interference voltages, the periodic switching of a low-resistance source to a capacitor being prevented.

BRIEF DESCRIPTION OF THE DRAWINGS

The invention is to be explained below in more detail with the aid of a plurality of exemplary embodiments. In the drawing.

BEST MODE FOR CARRYING OUT THE INVENTION

Figure 1A:
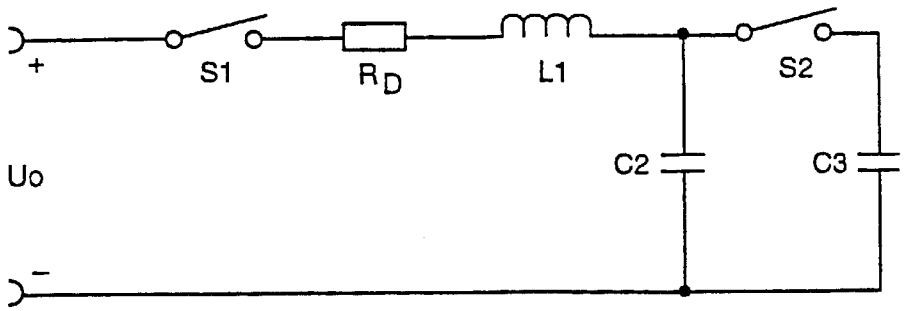
FIG. 1*a* shows an outline circuit diagram of the circuit arrangement.

FIG. 1*a* illustrates the basic circuit diagram. A transfer capacitor C2 connected in parallel with the lamp L is charged by the inductor current of the ballast inductor L1 (with associated resistor $R_D$) after a switching element S1 is switched through. An additional charging capacitor C3 is connected in parallel to the transfer capacitor via the switching element S2 for the purpose of further increasing the voltage.

Figure 1B:
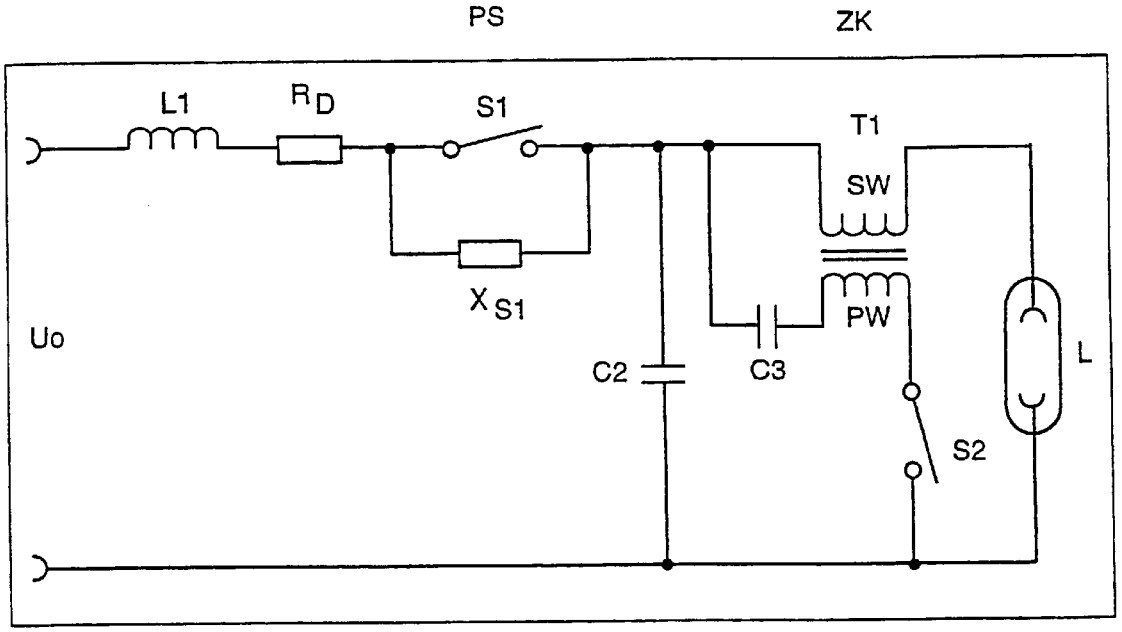
FIG. 1*b* shows the implementation of the circuit arrangement according to FIG. 1*a*.

The implementation of a circuit arrangement is shown in FIG. 1*b*. The lamp L to be operated thereby is, for example, a sodium high-pressure lamp with a power of 70 W. It replaces a 125 W mercury-vapor lamp with identical lighting data. The circuit arrangement is accommodated in the housing of the ballast L1 or directly in the lamp base or base housing, or connected as a separate unit downstream of the ballast L1. The circuit arrangement contains two series-connected networks, a phase-gating control PS and a superimposed starting circuit ZK.

Figure 1C:
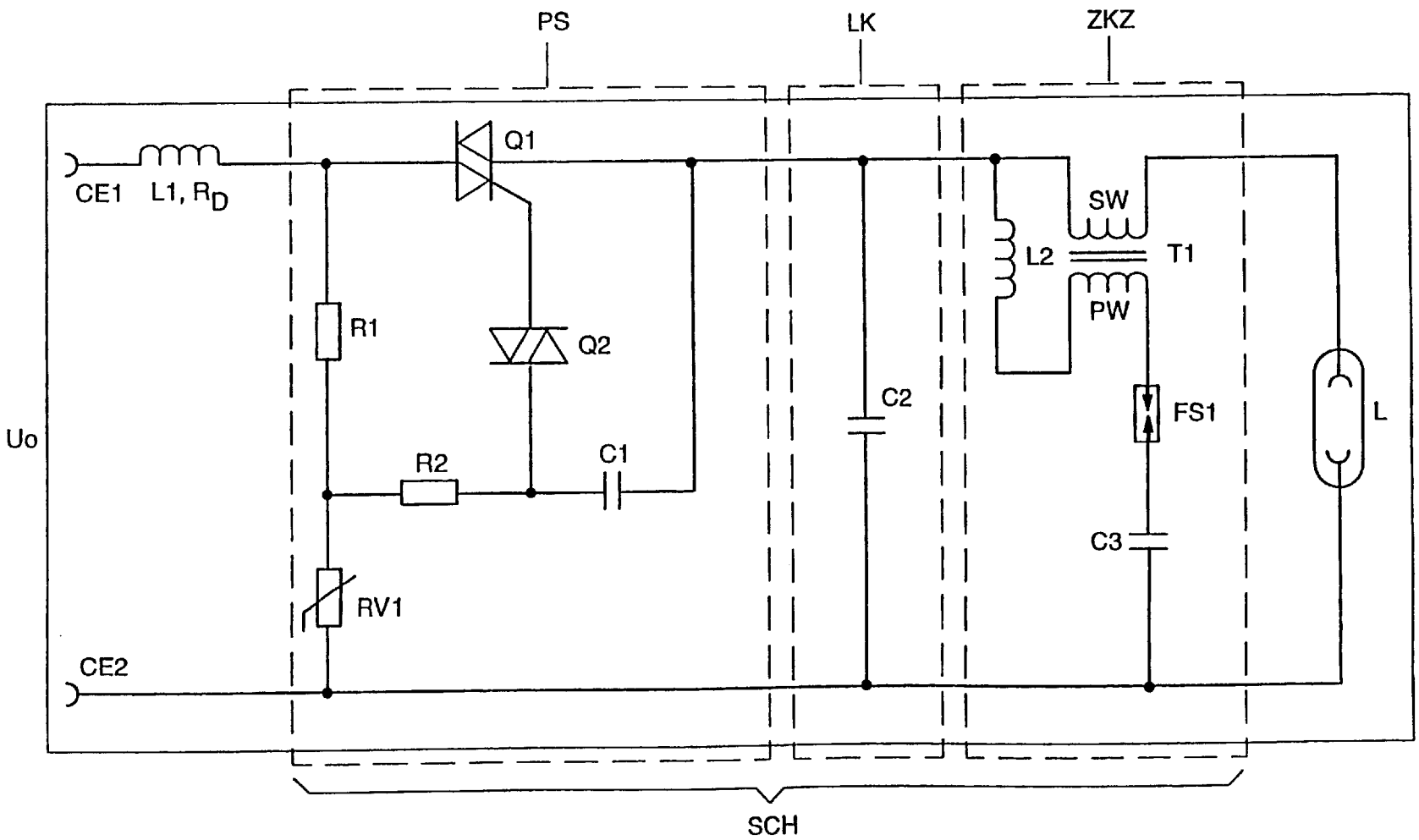
FIG. 1*c* shows the implementation of a preferred exemplary embodiment of the circuit arrangement according to FIG. 1*a*.

Serving as switching element in a preferred exemplary embodiment (FIG. 1*c*) is a triac Q1 which is connected in series in the lamp circuit directly downstream of the ballast impedance L1. The phase angle is determined by an RC element comprising the RC combination R1, R2, C1 arranged in series. This RC element is connected in parallel with the main electrodes of the triac Q1. The defined starting of the triac Q1 is performed via a diac Q2 which connects the control electrode of the triac to a contact point between R2 and C1. A varistor RV1 is inserted between R1 and the second line voltage contact CE2 in order to stabilize the phase angle in the case of a variable line voltage (corresponding to a stabilization of the charging voltage for the capacitor C1). The reduction in the power is performed by gating each sine half-wave with a phase angle of approximately 1.2 ms.

The starting circuit of the triac (comprising the RC element R1, R2, C1 and the diac Q2) has only a single-ended DC coupling to the reference potential. This permits a particularly simple design. An essential component of the starting circuit is a starting capacitor C2, which bridges the output of the phase-gating control PS in parallel with the electrodes of the lamp. C2 is advantageously selected to be very much larger than C1. This provides a coupling to the reference potential (C1 can be charged), and enables the triac to be triggered.

C2 is firstly charged by the charging current of C1 after the line voltage has been applied, and is charged by the current of the ballast impedance L1 after the triac has been switched through. C2 forms a series resonant circuit with L1 (including the resistor $R_D$ of the ballast impedance L1 and the resistor $X_{S1}$ of the switching element S1). In this case, Q1 is the associated switch S1, as illustrated in the outline circuit diagram (FIG. 1*a*) in which the series circuit composed of $R_D/X_{S1}$/L1/C2 is represented.

Overall, the circuit arrangement thus comprises the phase-gating network PS, the charging circuit LK containing C2, and the additional starting circuit ZKZ.

Figure 2A:
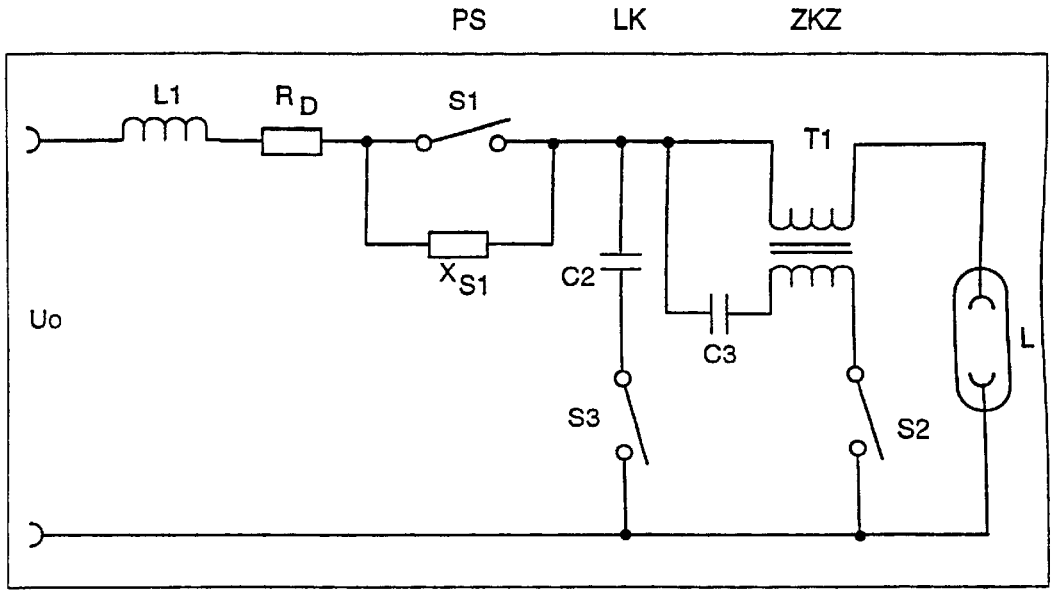
FIG. 2*a* shows a circuit diagram of the operating principle with disconnection of the transfer capacitor and DC coupling of the triac starting circuit.
Figure 2B:
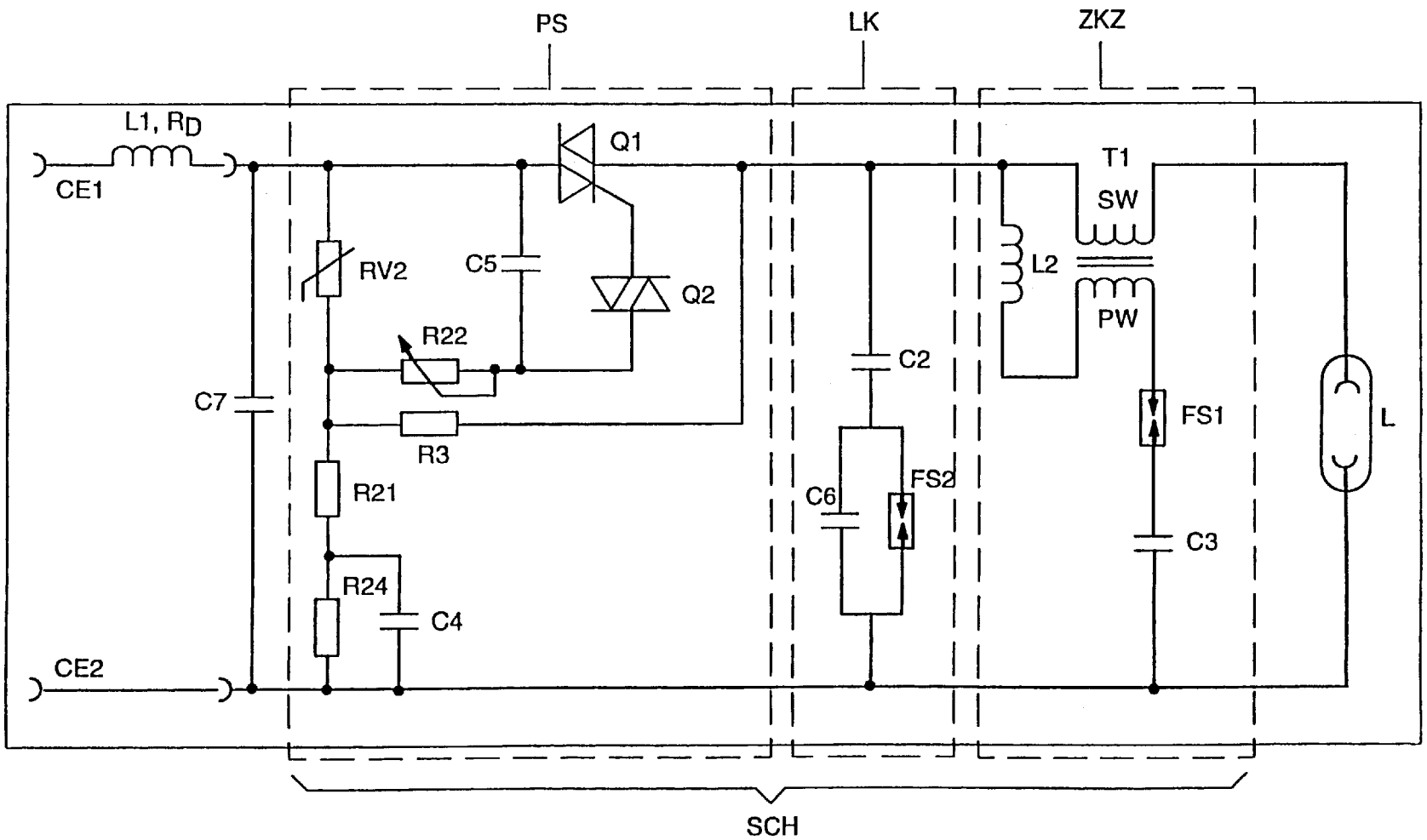
FIG. 2*b* shows the circuit arrangement of a further preferred exemplary embodiment.
Figure 3A:
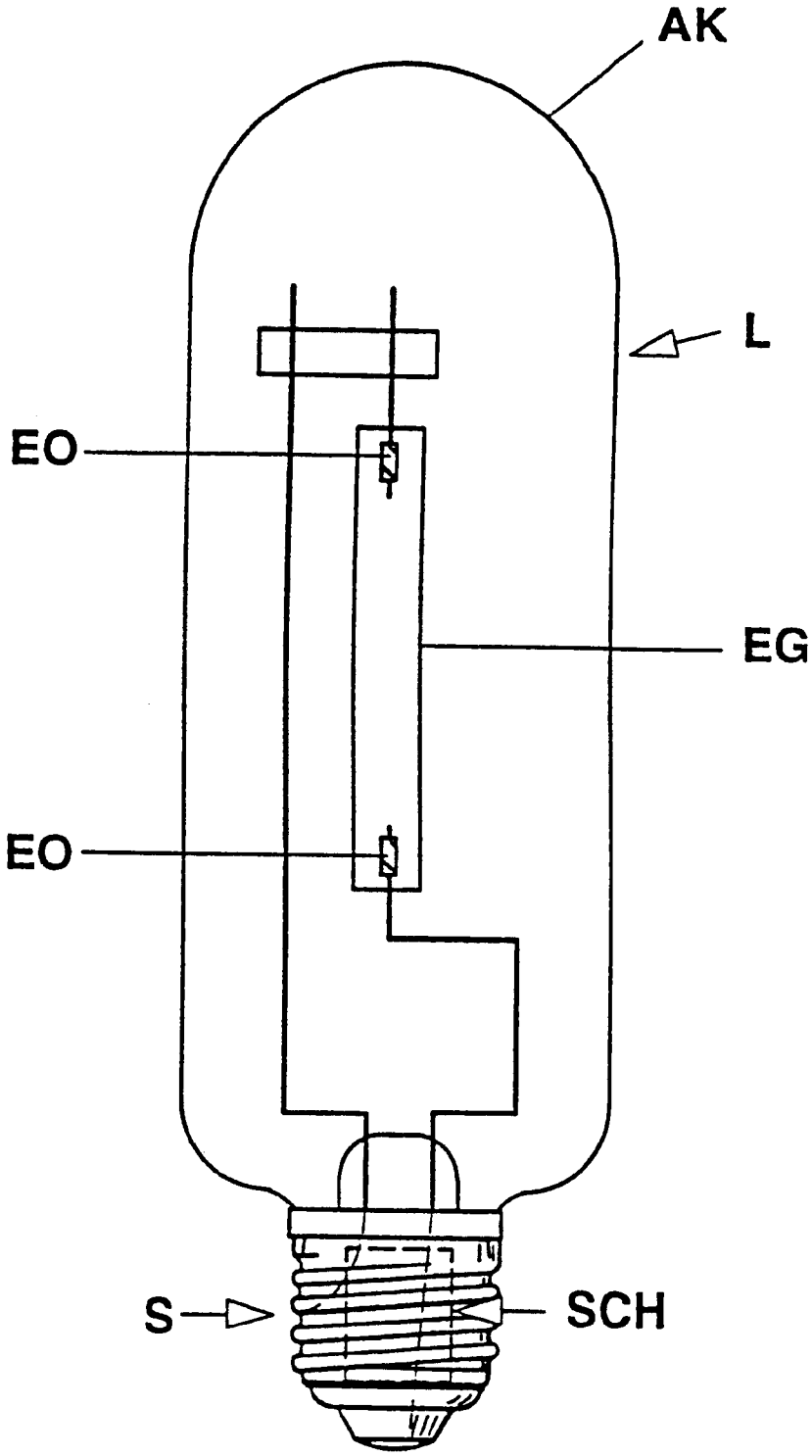
FIG. 3*a* shows a lamp with a circuit arrangement integrated in the base.

FIG. 2 shows a particularly advantageous circuit arrangement SCH which is preferably integrated in the base (threaded part) S of a sodium high-pressure lamp L, see FIG. 3*a*. The lamp has an outer bulb AK and a ceramic discharge vessel EG in which two electrodes EO are situated opposite one another. The filling of the discharge vessel dispenses with mercury and uses only sodium and approximately 2 bars of xenon (cold).

Figure 3B:
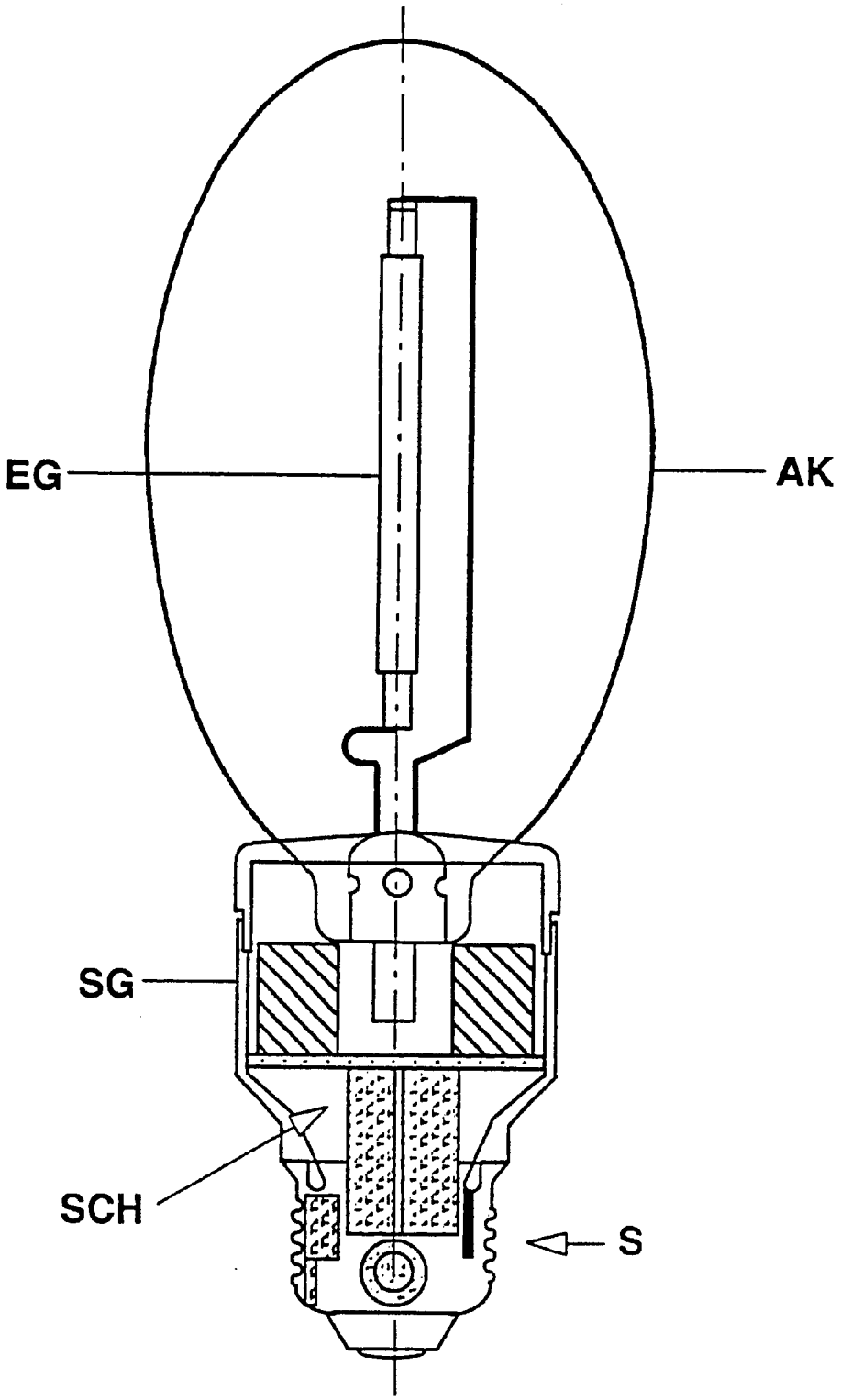
FIG. 3*b* shows a lamp with a circuit arrangement integrated in the base housing.

However, the circuit arrangement SCH can also be accommodated at least partially in a separate base housing SG (or in an operating unit together with the ballast impedance), see FIG. 3*b*.

The circuit arrangement SCH is represented in principle in FIG. 2*a*, and in a concrete implementation in FIG. 2*b*. The advantage of the circuit according to FIG. 2*b* is the defined coupling of the triac Q1 (and its associated gate circuit), the result of which is to prevent the charge of C2 from swinging back even in the case of slower types, and to yield a square-wave transfer voltage with possible values which are even higher than $2*\sqrt{2}*$Uo_eff. The resistor R3 can be used to set the level of the transfer voltage. The magnitude of R3 is strongly dependent on the phase angle. The maximum achievable level of the transfer voltage is essentially determined by the quality of the capacitor C2 and by the blocking voltage of the triac Q1. Moreover, the switching element S3 decouples the transfer capacitor C2 after the lamp has been fully started and transferred. A spark gap FS2 with a breakdown voltage higher than the lamp operating voltage is used as S3. An increased radio-interference voltage such as occurs when a low-resistance source is switched onto a capacitor is thereby avoided. The magnitude of R22 depends on the lamp impedance. The voltage across C4 should be symmetrical in any case.

The line voltage (present between the contacts CE1 and CE2) is fed to the circuit arrangement SCH via the separate ballast already used—specifically, originally for a 125 W mercury-vapor lamp—with the impedance L1, which is directly connected to the contact CE1. This is a conventional unit.

In addition to the parts, already described, of a phase-gating control PS, the circuit arrangement contains a further network ZKZ for generating a particularly high high-voltage pulse for starting the lamp, comprising a starting transformer T1, a capacitor C3 and a switching element FS1, situated therebetween, in the form of a spark gap.

The voltage of C2 is also present across the spark gap FS1. If the starting voltage of the spark gap FS1 has been reached, the latter breaks down and C3 is charged. The current now flowing (approximately 100 A) generates in the primary winding PW of T1 a voltage which is stepped up via the secondary winding SW and is present at the lamp L. The capacitor C2 blocks the high voltage from the remainder of the circuit (in particular from the lamp ballast inductor L1). Moreover, C2 closes the circuit toward the lamp. This process is repeated several times within a half wave, a charge division taking place in each case between C2 and C3 (voltage rise across C3, voltage drop across C2). The starting pulse is additionally shaped with the aid of an additional inductor L2 in the starting circuit ZKZ.

Figure 4:
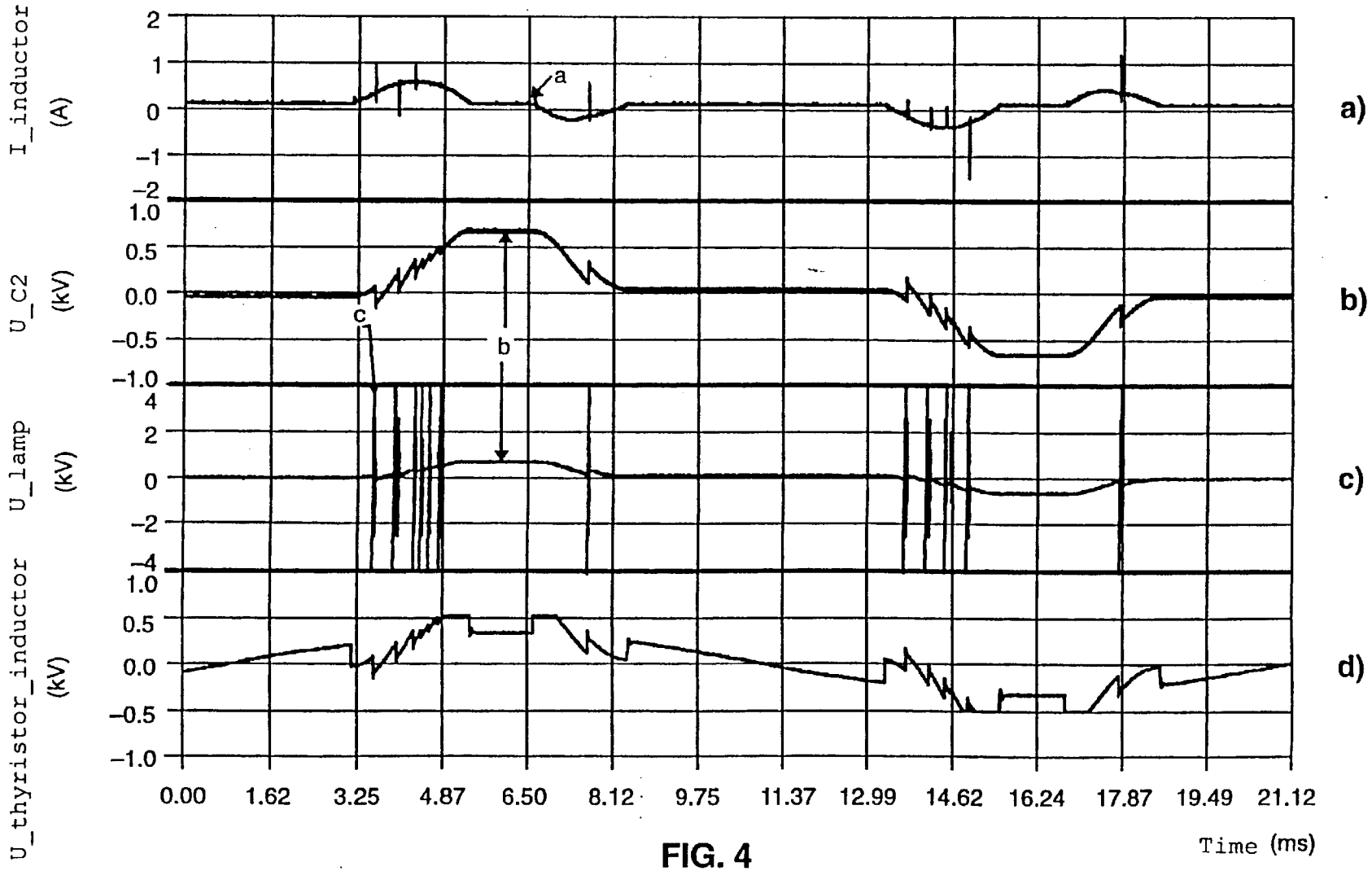
FIG. 4 shows the current and voltage profiles in accordance with FIG. 2*b*.

FIG. 4 shows the current and voltage profiles as a function of time for the exemplary embodiment of FIG. 2*b* over a period of 21 ms. FIG. 4*a* shows the current (in A) in the ballast inductor L1. FIG. 4*b* shows the voltage (in kV) across the starting capacitor C2. The transfer voltage U_C2 is approximately 0.7 kV (700 V). It is also present equally between the electrodes of the lamp L, as FIG. 4*c* illustrates. The operating voltage between the electrodes (in kV) is specified there. Also to be seen there are the starting pulses. Finally, the voltage (in kV) across the inductor L1 is plotted in FIG. 4*d*.

This circuit arrangement permits an exceptionally compact implementation, with the result that it can be accommodated in the customary screw base of a high-pressure discharge lamp or in a small (customary) screw housing (FIG. 3). There is no need in this case either for auxiliary electrodes on the discharge vessel or for an internal starter in the outer bulb.

Concrete values for the components used are to be found in the attached lists 1 and 2.

Figure 5:
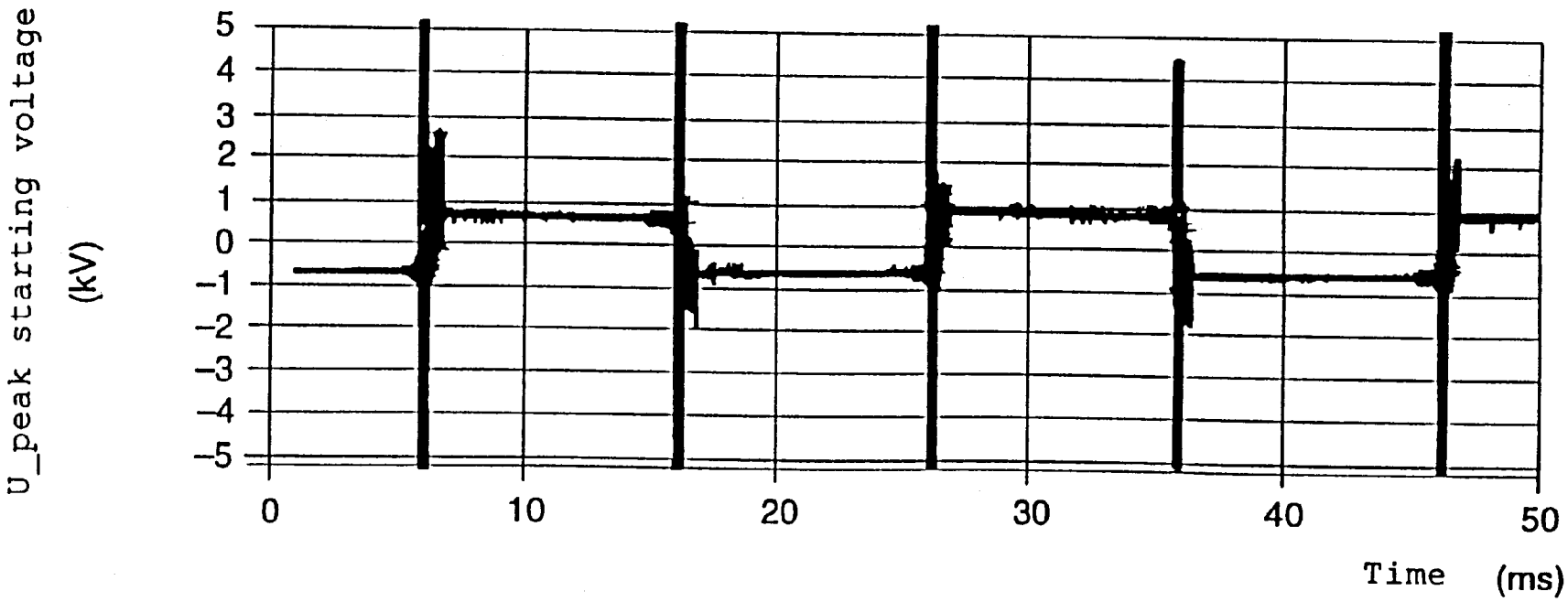
FIG. 5 shows the transfer voltage and starting pulse of the circuit according to FIG. 2.

FIG. 5 shows the transfer voltage (in kV) with the starting pulses of the circuit variant in accordance with FIG. 2*b*. The starting pulses are repeated approximately every 10 ms.

Figure 6:
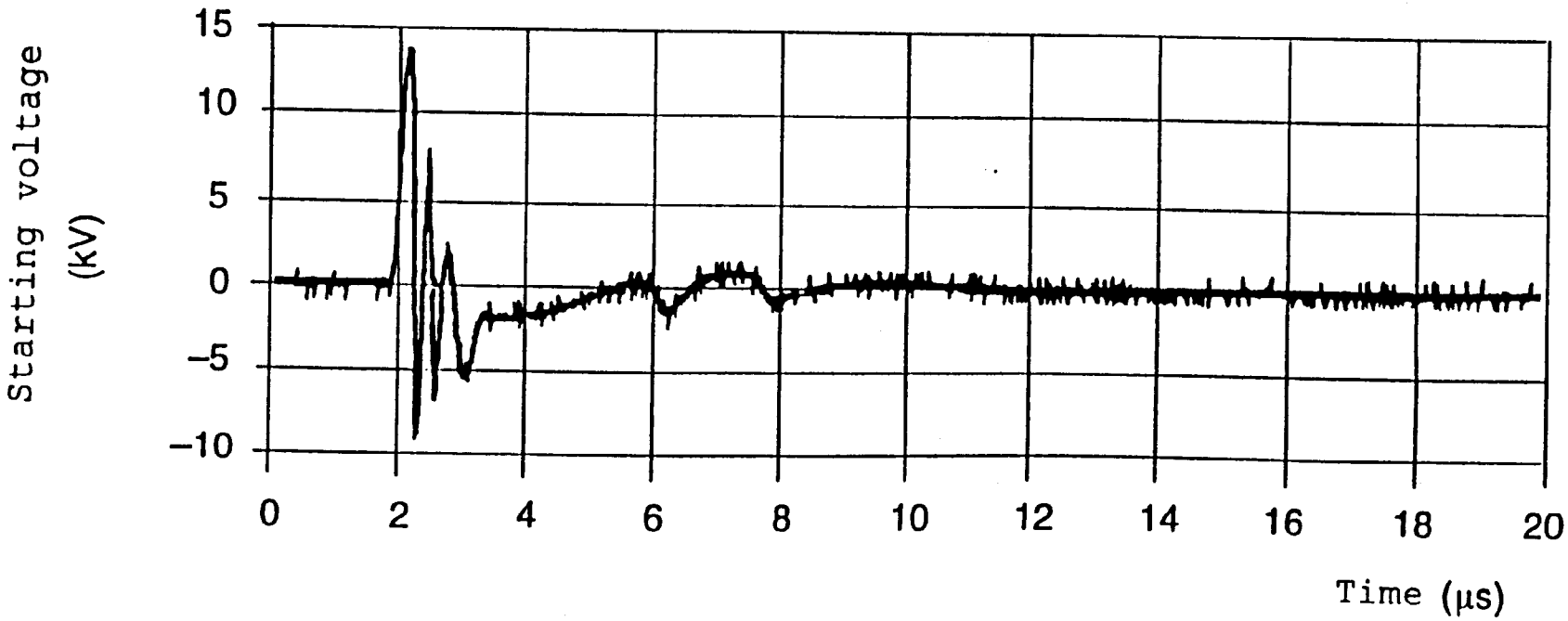
FIG. 6 shows the time-resolved starting pulse.

FIG. 6 shows an individual starting pulse with a high time resolution of 2 $\mu$s.

Figure 7:
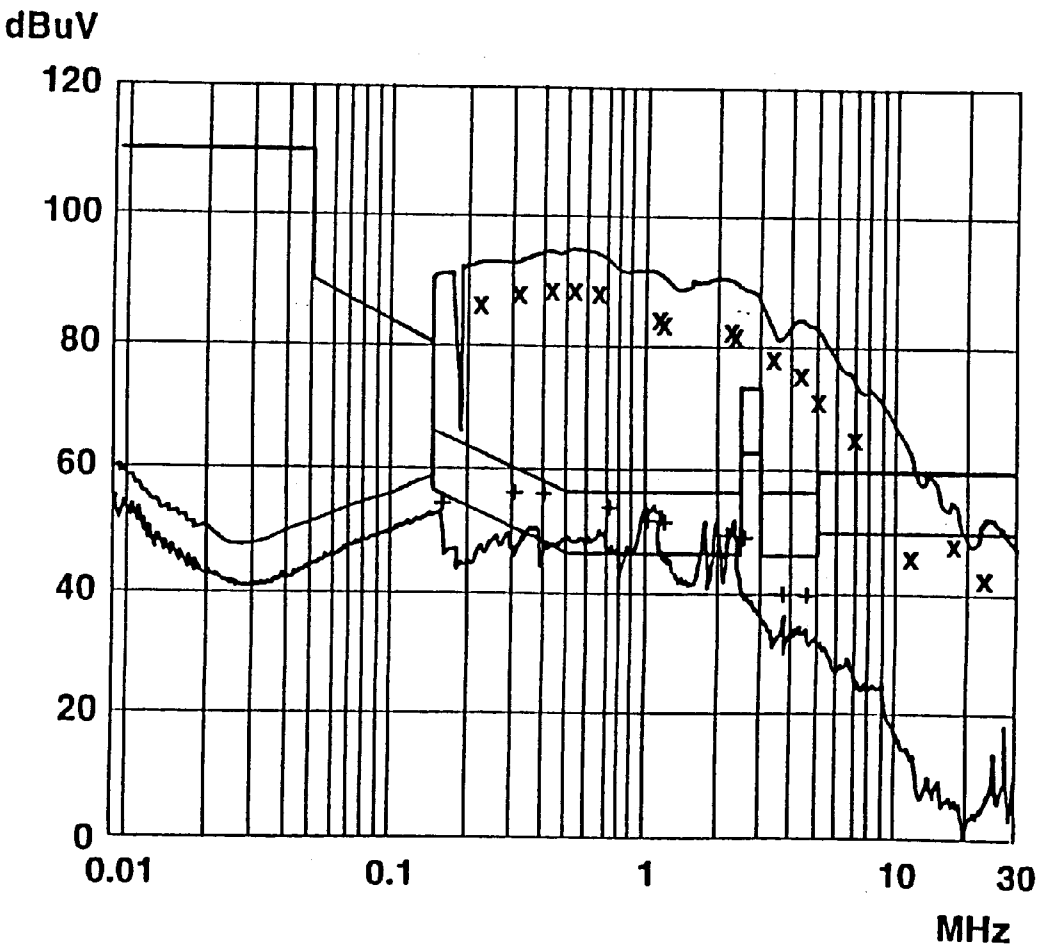
FIG. 7 shows the radio-interference voltage measurement of the circuit according to FIG. 1*b*.
Figure 8:
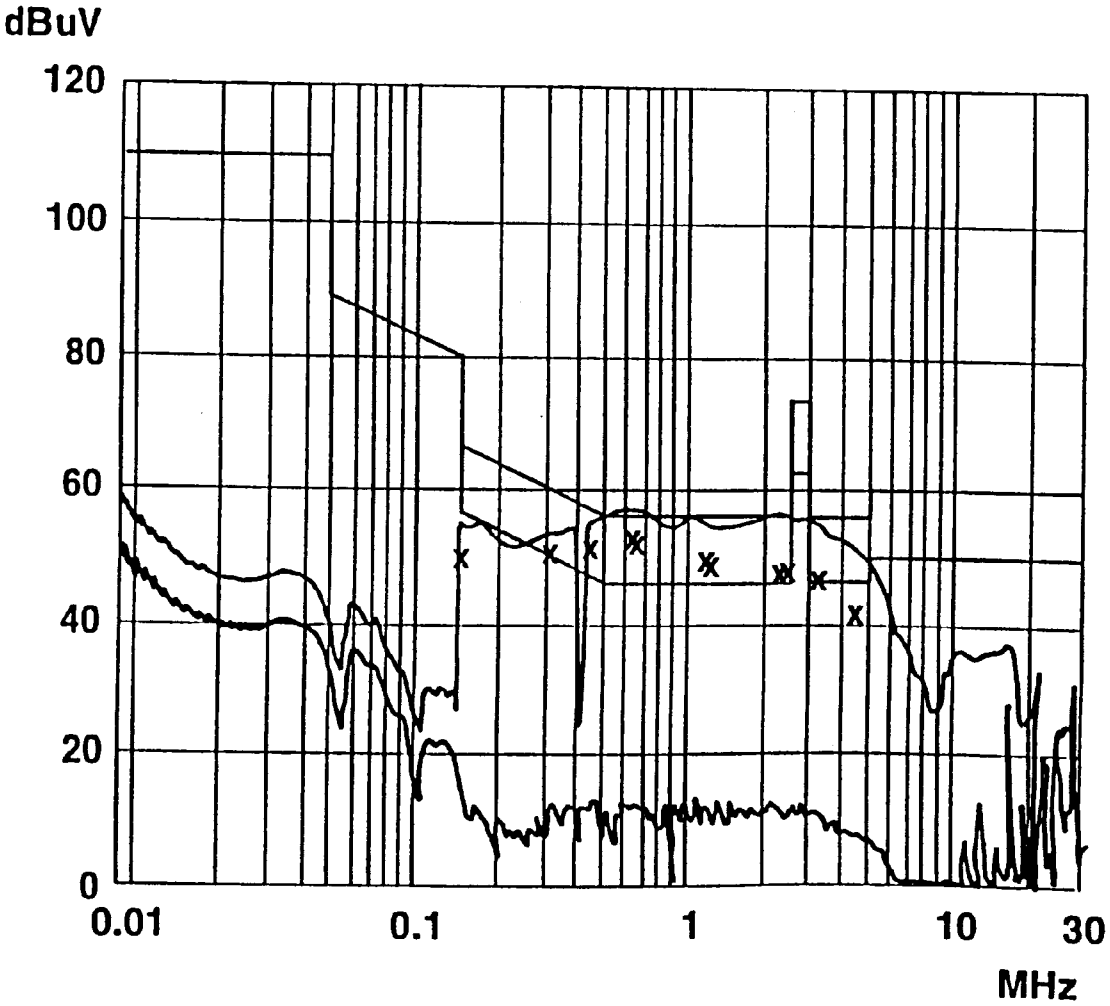
FIG. 8 shows the radio-interference voltage measurement of the circuit according to FIG. 2*b*.

FIG. 7 shows the result of the radio-interference voltage measurement of the circuit according to FIG. 1*b*. FIG. 8 shows the result of the radio-interference voltage measurement of the circuit according to FIG. 2*b*.

Figure 9A:
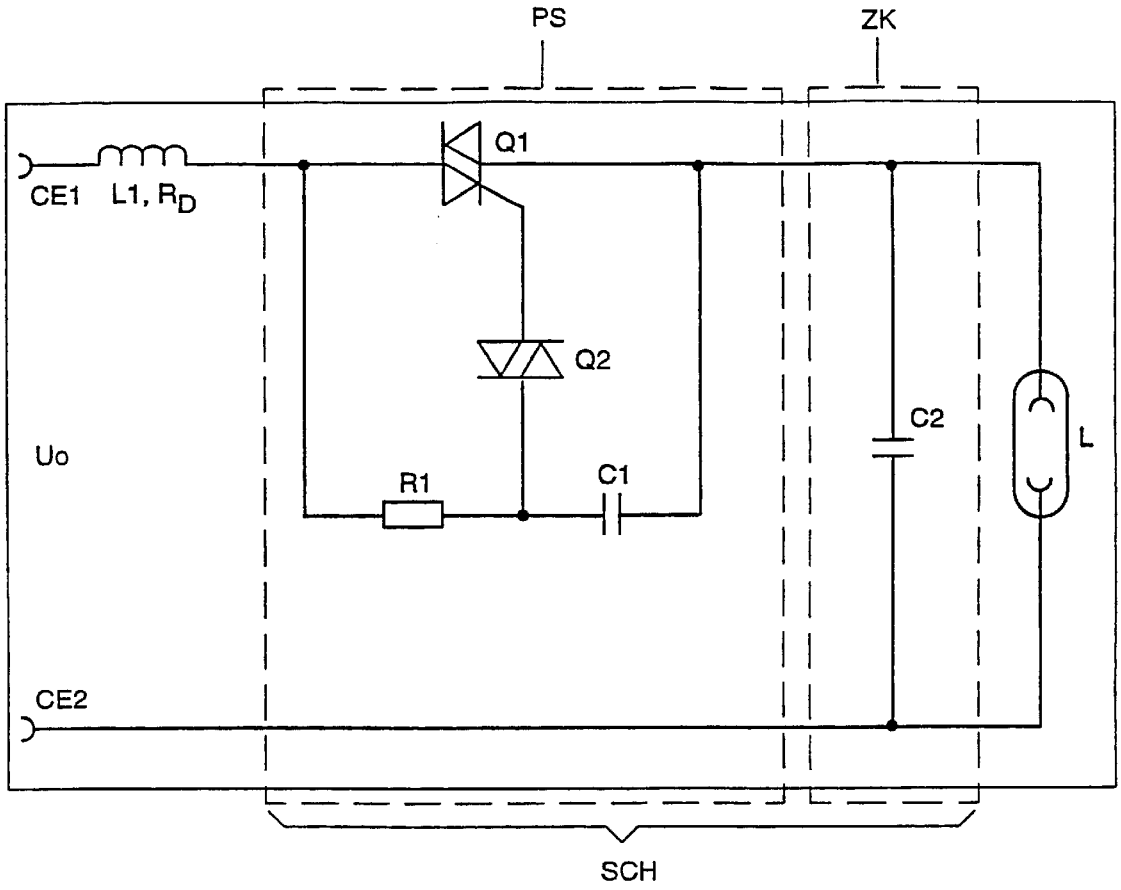
FIG. 9*a* shows a further exemplary embodiment of a circuit arrangement.
Figure 9B:
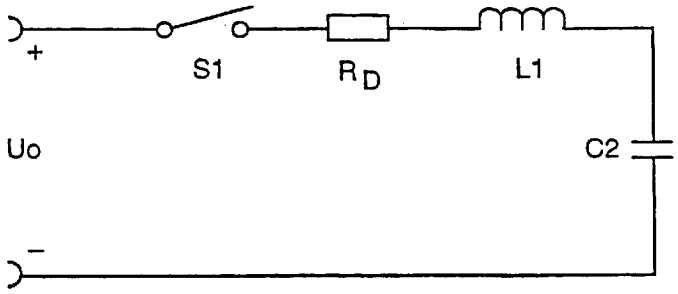
FIG. 9*b* shows the principle of the circuit of FIG. 9*a*.

A further exemplary embodiment of a circuit arrangement is shown in FIGS. 9*a* and 9*b*. The lamp to be operated thereby is, for example, a sodium high-pressure lamp with a power of 70 W. It replaces an 125 W mercury-vapor lamp with identical lighting data. The circuit arrangement is accommodated in the housing of the ballast or connected as a separate unit downstream of the ballast. The circuit arrangement comprises two series-connected parts, a phase-gating control PS and an elementary starting circuit ZK.

The power is reduced by gating each sine half-wave with a phase angle of approximately 1.5 ms. A triac Q1 (connected in series into the lamp circuit directly downstream of the ballast impedance L1) serves as switching element. The phase angle is determined by an RC element, comprising the RC combination R1, C1 arranged in series. This RC element is connected in parallel with the main electrodes of the triac Q1. The defined triggering of the triac is performed via a diac Q2 which connects the control electrode of the triac to a contact point between R1 and C1.

The starting circuit of the triac (consisting of the RC element R1, C1 and the diac Q2) has only a single-sided DC coupling to the reference potential. This permits not only a particularly simple design of the triac starting circuit, but it is also possible as a result to implement a closing operation with the inclusion of the starting circuit of the lamp. An essential component of the starting circuit is a starting capacitor C2, which bridges the output of the phase-gating control PS in parallel with the electrodes of the lamp. C2 is advantageously selected to be very much larger than C1 (typically 10 to 100 times larger). This provides coupling to the reference potential (C1 can be charged), and permits the triac to be triggered.

In addition to C2, the lamp starting circuit ZK of this circuit arrangement also makes use of networks which are known per se. It can additionally also utilize superimposed starting. After the line voltage has been applied, C2 is firstly charged by the charging current of C1, and after the triac has been switched through it is charged by the current of the ballast impedance L1. C2 forms a series resonant circuit with L1 and the resistor $R_D$ thereof. In this case, Q1 is the associated switch S1, as illustrated in the outline circuit diagram (FIG. 9*b*), in which the series circuit composed of $R_D$/L1/C2 is represented. The switch S1 symbolizes the sudden switching-in. A voltage rise to twice the line voltage $U_0$ is thereby possible.

List 1 (re FIG. 1*c*)
R1=56 k
R2=680 k
RV1=Varistor 60 V
C1=10 nF
C2=470 nF/400 V B32522 MKT
C3=470 nF/400 V B32522 MKT
L1=customary (HQ 125 W)
T1=R36, N30, 4/100 turns (Siemens)
L2=6 $\mu$H, 1.5 A Siemens 565-2
Q1=e.g. BTB12BW
Q2=DB3 or similar
FS1=~380 V List 2 (re FIG. 2*b*)
R21=56 k
R22=680 k (phase angle 1.2 ms)
R3=~6.8 M for transfer voltage=600 V
R24=680 k
RV2=Varistor 60 V
C5=10 nF
C2=100 nF/630 V B32652 MKT
C3=100 nF/630 V B32652 MKT
C4=6.8 nF/400 V (200 V~)
C7=1 nF (230 V~)
C6=100 pF
L1=customary (HQ 125 W)
T1=R25/10, N27, 4/90 turns (Siemens)
L2=6 $\mu$H, 1.5 A Siemens 565-2
Q1=e.g. BTA12BW
Q2=DB3 or similar
FS1=~550 V
FS2=~230 V

What is claimed is:

1. A circuit arrangement for starting and for operating a high-pressure discharge lamp having electrodes at a ballast impedance (L1), the circuit arrangement comprising at least one starting device and a capacitor (transfer capacitor C2) which is connected in parallel indirectly or directly with the lamp and forms a resonant circuit together with the ballast impedance (L1) in operation, wherein means in the circuit arrangement are suitable for charging the capacitor (C2) connected in parallel with the lamp up to a voltage which is higher than the input voltage of the circuit arrangement, the result of this being that in addition to a starting pulse the electrodes are provided with a transfer voltage which is distinctly higher than the input voltage of the circuit.

2. The circuit arrangement as claimed in claim 1, wherein the increased transfer voltage is provided by a closing operation, triggered by a switching element (S1), or by resonant increase or by a combination of the two measures.

3. The circuit arrangement as claimed in claim 1, wherein connected indirectly or directly in parallel with the transfer capacitor (C2) are one or more further capacitors (C3) of an additional starting circuit (ZKZ), in particular via a further switching element (S2), which are charged up to a higher voltage than the input voltage of the arrangement, and wherein as a result thereof an increased transfer voltage can be available at the electrodes.

4. The circuit arrangement as claimed in claim 1, wherein the starting device is designed as a superimposed circuit.

5. The circuit arrangement as claimed in claim 1, wherein the circuit has at least one further circuit for power reduction (PS) which, in particular, comprises a phase-gating control.

6. The circuit arrangement as claimed in claim 5, wherein the further circuit contains a phase-gating control with a switching element (Q1) and a starting circuit, in particular an RC element (R1, R2, C1), determining the phase angle.

7. The circuit arrangement as claimed in claim 6, wherein the phase angle is additionally stabilized by a further electronic component.

8. The circuit arrangement as claimed in claim 3, wherein the starting circuit (ZKZ) uses a spark gap (FS1) or a semiconductor switch as switching element (S2).

9. The circuit arrangement as claimed in claim 1, wherein after completed transfer of the lamp, the transfer capacitor (C2) connected indirectly or directly in parallel with the lamp can be separated from one or both lamp electrodes by a serially connected switching element (S3).

10. The circuit arrangement as claimed in claim 9, wherein the switching element (S3) for electrically separating the transfer capacitor (C2) is a spark gap (FS2) or a semiconductor switch.

11. The circuit arrangement as claimed in claim 1, wherein the ballast impedance L1 is designed as a separate component (inductive ballast).

12. A high-pressure discharge lamp having electrodes for operating at a ballast impedance (L1), having a base (S) and having a discharge vessel (EG) in which two electrodes (EO) are arranged which are connected to a circuit (SCH) in the base (S), wherein the circuit comprises at least one starting circuit (ZK), a capacitor (transfer capacitor C2), connected in parallel with the discharge vessel (EG), in the starting circuit, which forms a resonant circuit together with the ballast impedance in operation, being charged up to a voltage which is higher than the input voltage of the circuit and thereby has the effect that the electrodes in the discharge vessel (EG) are provided with a transfer voltage which is distinctly higher than the input voltage.

13. A high-pressure discharge lamp having a base and a circuit accommodated at least partially in the base, this circuit comprising a circuit arrangement as claimed in claim 1.

14. The high-pressure discharge lamp as claimed in claim 12, wherein the base (S) comprises a threaded part and, if appropriate, additionally a housing part (SG), the circuit being accommodated at least partially in the threaded part and/or in the housing part.

15. The high-pressure discharge lamp as claimed in claim 12, wherein the discharge vessel (EG) of the lamp contains a filling with at least one metal vapor and an inert gas, the inert gas having a cold filling pressure of at least 1 bar.

16. The high-pressure discharge lamp as claimed in claim 12, in particular having a very high cold filling pressure of between 1 and 3 bar in the discharge vessel, wherein one or more charge stores (capacitors) are connected indirectly or directly in parallel with the lamp and are charged up to a voltage which is higher than the input voltage of the arrangement and is thus available as transfer voltage, the starting device being designed as a superimposed circuit.

17. The high-pressure discharge lamp as claimed in claim 16, wherein the lamp and starting circuits are supplied by a phase-gating control which permits a power reduction in some circumstances.

18. The high-pressure discharge lamp as claimed in claim 12, wherein the voltage increase for the transfer voltage is achieved by a closing jump on an R/L/C series circuit and/or by resonant increase at the transfer capacitor (C2).

19. The high-pressure discharge lamp as claimed in claim 17, wherein the phase-gating control is influenced by a control circuit or control loop in evaluating the lamp voltage and/or the lamp current and/or the lamp power.

* * * * *